United States Patent [19]

Pritchitt

[11] 4,372,467

[45] Feb. 8, 1983

[54] DISPENSING VALVE TO BE USED WITH BOTTLES OF FLUENT IMAGING MATERIAL FOR THE DEVELOPMENT OF ELECTROSTATIC IMAGES

[75] Inventor: Frederick J. Pritchitt, Kingston, N.Y.

[73] Assignee: Marpac Industries, Inc., Kingston, N.Y.

[21] Appl. No.: 303,379

[22] Filed: Sep. 18, 1981

Related U.S. Application Data

[63] Continuation-in-part of Ser. No. 157,510, Jun. 9, 1980, abandoned.

[51] Int. Cl.[3] ..... B65D 47/06

[52] U.S. Cl. ..... 222/501; 222/518; 251/322; 251/323; 251/357

[58] Field of Search ..... 222/501, 518; 251/322, 251/323, 357

[56] References Cited

U.S. PATENT DOCUMENTS

| | | | |
|---|---|---|---|
| 780,929 | 1/1905 | Angehr | 251/357 X |
| 1,305,476 | 6/1919 | McCord | 222/453 |
| 1,746,727 | 2/1930 | Dunlap | 222/453 |
| 1,864,133 | 6/1932 | Hammer | 222/501 |
| 2,764,324 | 9/1956 | Landreth | 222/501 |
| 2,801,032 | 7/1957 | Hall | 222/453 X |
| 2,851,243 | 9/1958 | Tannock | 251/357 X |
| 3,155,367 | 11/1964 | Gifford | 251/357 X |
| 3,749,287 | 7/1973 | Sanders | 222/DIG. 1 |
| 4,014,365 | 3/1977 | Peterson et al. | 251/323 X |
| 4,164,307 | 8/1979 | Imamura | 222/501 X |
| 4,196,886 | 4/1980 | Murray | 251/357 |

FOREIGN PATENT DOCUMENTS

| | | | |
|---|---|---|---|
| 534273 | 9/1931 | Fed. Rep. of Germany | 222/325 |

*Primary Examiner*—Joseph J. Rolla
*Assistant Examiner*—Frederick R. Handren
*Attorney, Agent, or Firm*—Kirschstein, Kirschstein, Ottinger & Cobrin

[57] ABSTRACT

A dispensing valve to be used with a bottle of fluent imaging material. The valve is so structured that it can be assembled more rapidly and easily than existing dispensing valves used for the same purpose. The new valve holds the valve plug and the biasing spring in proper relative position on the actuating spindle without the use of retaining rings and does not require a jig for its assembly.

3 Claims, 8 Drawing Figures

FIG. 1
PRIOR ART
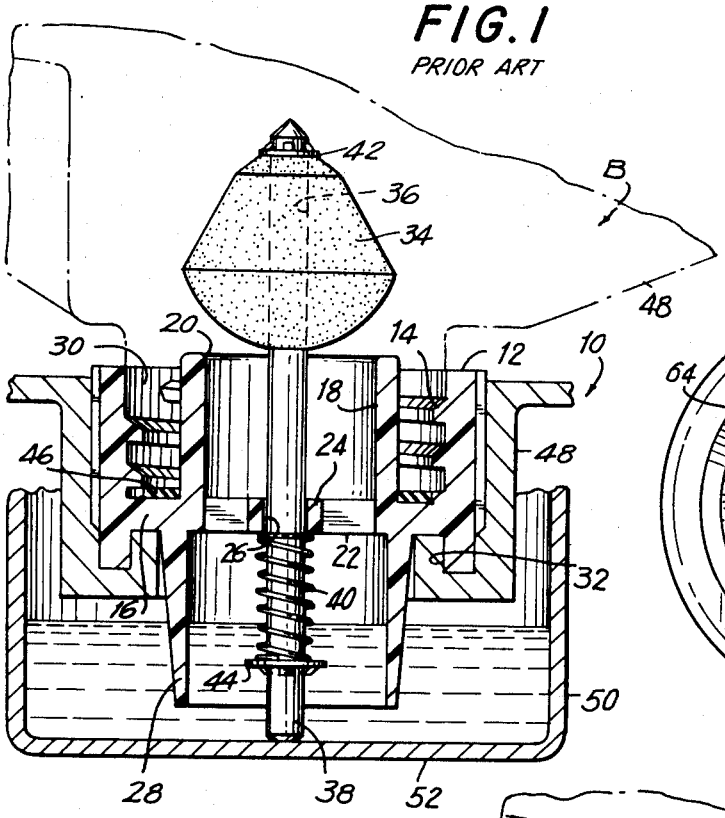
FIG. 3
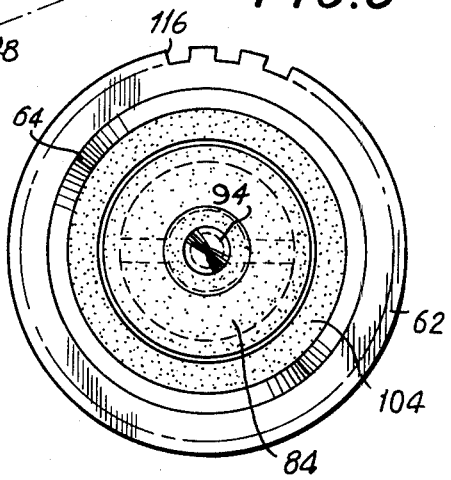
FIG. 1a
PRIOR ART
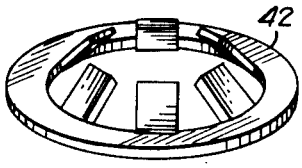
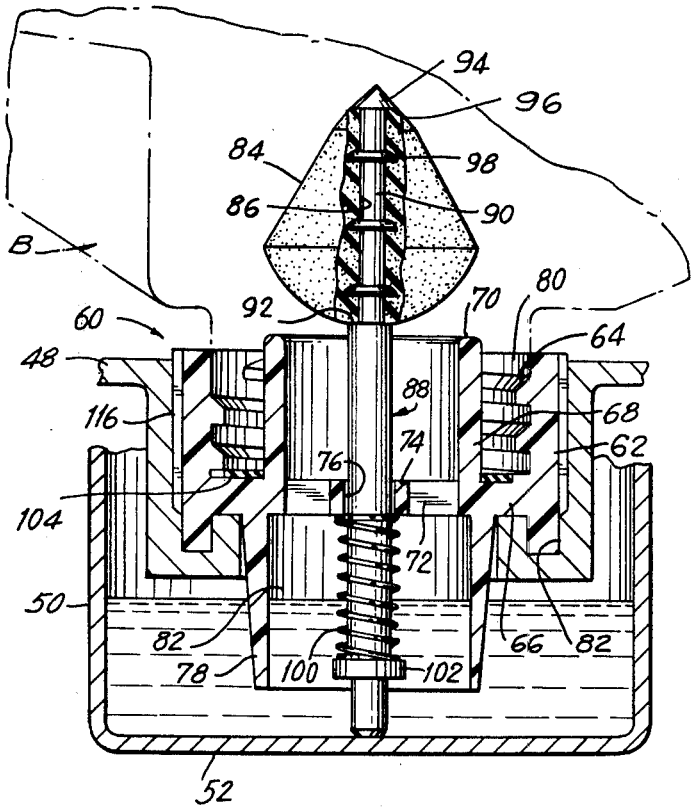
FIG. 2

FIG. 5
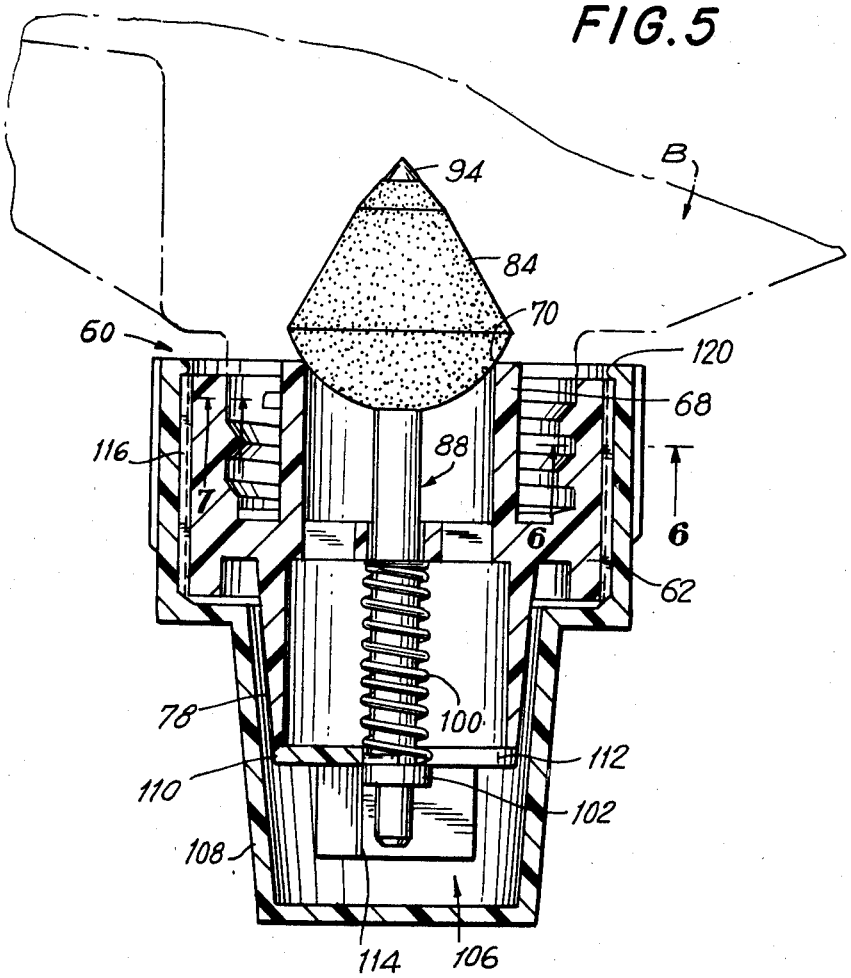
FIG. 4
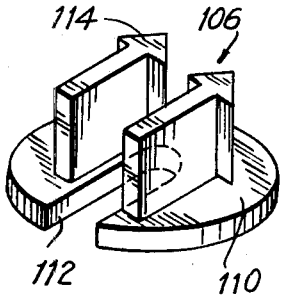
FIG. 6
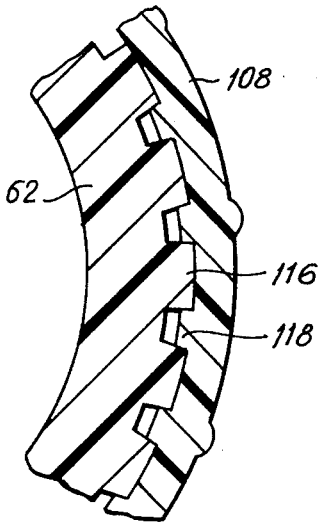
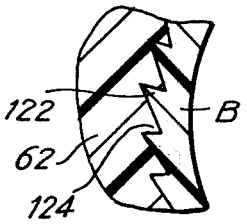
FIG. 7

DISPENSING VALVE TO BE USED WITH BOTTLES OF FLUENT IMAGING MATERIAL FOR THE DEVELOPMENT OF ELECTROSTATIC IMAGES

CROSS-REFERENCE TO RELATED APPLICATION

This invention is a continuation-in-part of co-pending application Ser. No. 157,510, filed June 9, 1980, now abandoned, for DISPENSING VALVE TO BE USED WITH BOTTLES OF FLUID DEVELOPER.

BACKGROUND OF THE INVENTION

1. Field of the Invention

A dispensing valve adapted to dispense fluent imaging materials used in electrostatographic copying machines, the valve being designed to be attached to the downwardly facing mouth of an inverted bottle containing such a material.

2. Description of the Prior Art

Dispensing valves are well known in the industry. It is a valve which customarily is attached to the mouth of a fluid-containing bottle when the bottle is erect, that is to say, when its mouth faces upwardly. At this time the valve is biased to closed position. The bottle then is inverted. No fluid will flow out of the bottle because the valve is biased to closed position. The bottle with the valve attached and in upside down position is placed on a support in conjunction with a machine in which the bottled fluid is designed to be employed. The support holds the bottle upside down. Within the receptacle an element engages an actuating member of the dispensing valve to displace a valve plug upwardly and thereby open the valve. In one mode of use the dispensing valve remains open during its period of operation and will automatically dispense fluid, usually liquid, into the machine as a function of the prevailing hydrostatic pressures. In this mode the valve sometimes is referred to as a birdfeeder. Heretofore such a valve has constituted a plug mounted on a spindle and biased to closed position against a valve seat in the valve body. The plug frictionally engages the spindle. Movement of the plug off the spindle was prevented by a retainer ring. The degree of compression of the spring was fixed by the position of another retainer ring on the spindle. The two retainer rings had to be located on the spindle with a reasonable degree of precision in order to properly position the plug and to impart the proper degree of composition to the spring. Because several elements had to be manipulated during assembly of the components of the dispensing valve and because the plug and spring had to be correctly located, it has been necessary to assemble the parts of the valve with the aid of a jig. This has unduly raised the cost of assembly and unduly slowed the production line, both factors having tended to increase the production cost of the valve. The prior art birdfeeder valve is detailed in a later portion of this specification with relationship to a figure that shows the structure. In another mode of use the dispensing valve is intermittently opened and closed by a member, e.g., a flipper, that periodically presses up against the lower end of the spindle to lift the plug when a sensing element determines that additional fluid is required and allows the spindle and plug to drop either after a predetermined period of time or after the need for additional fluid has been supplied.

SUMMARY OF THE INVENTION

Purpose of the Invention

It is an object of the invention to provide a dispensing valve of the character described which is not subject to the foregoing drawbacks.

It is another object of the invention to provide a dispensing valve of the character described which employs a lesser number of parts than prior art dispensing valves.

It is another object of the invention to provide a dispensing valve of the character described which is simpler and requires less manpower to assemble than the prior art dispensing valves and can be put together with the aid of automatic machinery.

It is another object of the invention to provide a dispensing valve of the character described which can be made and sold at a lower cost than prior art dispensing valves.

It is another object of the invention to provide a dispensing valve of the character described which can be assembled without the use of a jig.

It is another object of the invention to provide a dispensing valve of the character described which is so structured that the assembly thereof predeterminedly locates the valve plug and compresses the spring to a predetermined level.

Other objects of the invention in part will be obvious and in part will be pointed out hereinafter.

Brief Description of the Invention

The dispensing valve of the present invention is mounted on and, in use, forms an integral part of the bottle of fluent imaging material with which it is used. The bottle of such material conventionally is supplied to the customer in a supply container, usually plastic, whose mouth is closed for storage and shipment by a weak disc affixed as by adhesive or plastic welding onto the finish of the receptacle. The materials conventionally employed in such a container for use with a dispensing valve in the field of electrostatographic copies are liquid concentrate, working liquid toner, liquid carrier for the working liquid toners, this sometimes being referred to as a diluent, mono-component dry toner powder, dry particulate developer and carrier beads. Such powders have but little resistance to shear and therefore have flow characteristics similar to those of a liquid. These can be enhanced, if desired, by employing a vibrator in operative relationship to the supply container. The neck of such container is provided with one half of a coupling such as a male thread which cooperates with a female thread of a protective shipment cap that insures that the disc will not be ruptured in transit or in storage and until the disc is deliberately broken. The fluent material, if a liquid concentrate, is viscous, somewhat less viscous than honey at room temperature. The liquid concentrate conventionally includes a volatile liquid carrier, e.g., Isopar G or H. It contains a higher percentage of solids, both dissolved and insoluble in the liquid carrier. A working liquid toner is composed of the same materials but has a much higher percentage by volume of the liquid carrier.

A conventional electrostatographic copying machine of the type which employs a dispensing valve has a compartment in which the container of imaging material is adapted to be placed in inverted position, mouth down, with the protective cap removed and with a birdfeeder valve substituted for the cap. The birdfeeder valve is so designed that attaching the valve to the neck of the container will cause a point of the valve to penetrate the protective disc. The valve also includes a female threaded cap which is screwed onto the neck of the container after the shipment cap has been removed. The shipment cap is removed from the container and replaced with the cap of the birdfeeder valve while the container is erect, and it is only after such replacement that the container is inverted and inserted in the toner copying machine.

When the inverted container with its birdfeeder valve is inserted in the machine a support in the machine engages the container to hold the same in fixed position. With the container thus engaged, an actuator for the birdfeeder valve causes the valve to open. The lower part of the valve is submerged in a sump and fluent imaging material will flow from the bottle into the sump, being supplied essentially by demand without changing the position of the opened components of the valve.

The same valve, without modification, can be used for intermittent feed of liquid or of any dry powder.

As observed previously, prior art dispensing valves in the field of electrostatographic copying machines have been composed of a large number of parts, have required a jig for their assembly and needed delicate positioning of retainer rings to precisely locate the valve plug and to precisely compress a biasing spring to a desired degree. The present invention avoids these drawbacks by use of a structure which subsequently will be detailed and which utilizes a lesser number of parts and by the unique configuration and relative positioning of these parts all of which enable the new dispensing valve to be assembled without a jig and with automatic machinery, to locate the valve plug very simply and to automatically obtain a predetermined degree of compression of the spring.

Additionally, there are other structural novel arrangements which will be appreciated from the reading of the appended specification.

The invention accordingly consists in the features of construction, combinations of elements, arrangements of parts and series of steps which will be exemplified in the dispensing valve mounted as hereinafter described and of which the scope of the application will be indicated in the appended claims.

BRIEF DESCRIPTION OF THE DRAWINGS

In the accompanying drawings in which is shown one of the various possible embodiments of this invention, FIG. 1 is an axial sectional view through a prior art birdfeeder valve, on a fragmentarily shown bottle of liquid and located in a liquid copying machine;

FIG. 1*a* is a perspective view of a retainer ring used with the prior art valve;

FIG. 2 is an axial sectional view through a valve of the present invention, on a fragmentarily shown bottle of liquid and located in a liquid copying machine;

FIG. 3 is a bottom view of the valve shown in FIG. 2;

FIG. 4 is a perspective view of a retaining clip;

FIG. 5 is an axial sectional view of the new valve with the retaining clip and an overcap mounted thereon;

FIG. 6 is a fragmentary sectional view taken substantially along the line 6—6 of FIG. 5; and FIG. 7 is an enlarged fragmentary sectional view taken substantially along the line 7—7 of FIG. 5.

DETAILED DESCRIPTION OF THE PRIOR ART

Referring now to FIGS. 1 and 1*a* there is illustrated a prior art birdfeeder valve 10 for dispensing a liquid in an electrostatographic liquid copying machine. The valve is used in conjunction with a bottle B of liquid. The contents of the bottle may be a liquid toner concentrate, a working liquid toner or a carrier for a working liquid toner. The birdfeeder valve 10 includes seven components. In particular, the birdfeeder valve 10 includes a cap 12 (one component), made of a material which is inert to the organic liquid carrier and other components that are present in the liquid toner concentrate or in the working liquid toner. Such liquid usually is an Isopar such as Isopar G or H. An acceptable material from which to mold the cap 12 is a polyacetal. The skirt of the cap is formed with a female thread 14 designed to meshingly engage the male thread on the neck of the bottle B. As pointed out earlier herein, the cap is screwed onto an upright full bottle B of liquid, the mouth of which is closed for shipment and storage by a fragile disc, e.g., a metal foil disc, secured across the same. The cap includes an internally directed mid-flange 16 from which sleeve 18 extends upwardly. The reference point for "upwardly" is the bottom of the valve 10 attached to an inverted bottle which is its position in an operating liquid copying machine. The upper end of the sleeve constitutes a valve seat 20. A spider 22 is situated at the bottom of the sleeve 18. The hub 24 of the spider is formed with a central bore 26. A second sleeve 28 is formed integrally with the flange 16 and extends downwardly therefrom. The sleeves 18 and 28 are coaxial; however, the sleeve 28 may have an internal diameter somewhat larger than that of the sleeve 18. An annular well 30 is formed between the sleeve 18 and the skirt of the cap 12. Another annular well 23 is formed between the lower end of the cap and the sleeve 28, beneath the flange 16.

The second component of the birdfeeder valve 10 is a valve plug 34. The valve plug is made of an elastomeric material which is inert to the liquid carrier and other ingredients of the toner concentrate and the working toner that is in the bottle B, a useful material being Buna-N. The lower end of the valve plug 34 is of spherical domed configuration. The upper end of the valve plug is of upwardly tapering frustoconical configuration. Optionally, as illustrated, the upper end may include two segments of different angular inclinations, the lower segment being steeper and the upper segment being flatter. The valve plug 34 is fashioned with a central axial bore 36. Preferably the upper and lower surfaces of the valve plug are flat and perpendicular to the longitudinal axis of the bore.

The third component of the birdfeeder valve 10 is a stainless steel spindle 38 of uniform diameter from end to end except at the top which is pointed and the bottom which is chamfered. The spindle extends through the bore 36 of the plug 34, projecting both above and below the plug. The plug is a friction fit on the spindle. The spindle passes freely through the bore 26 in the hub of the spider 22. The valve plug 34 is located above the spider and is designed to be biased against the valve seat 20.

The fourth component is a stainless steel helical compression spring 40 which encircles the spindle 28 below the spider 22. One end of the spring is seated against the lower face of the spider hub 24.

The fifth and sixth elements of the birdfeeder valve 10 are stainless steel female friction push-type retainer rings 42 and 44, respectively (see also FIG 1*a*). One such ring 42 frictionally engages the spindle 38 above the valve plug, the other ring 44 frictionally engages the spindle 38 below the spring 40. The spring 40 is held under compression between the spider hub 24 and the ring 44. The ring 42 defines the upper location of the upper surface of the valve plug 34. The rings are pushed into place and cannot readily back off. They tend not to be precisely positioned.

The seventh and last component is a sealing gasket 46 seated at the bottom of the well 30 to prevent leakage of liquid when the cap 12 is screwed on the mouth of the liquid-containing bottle B. The gasket is formed of a resilient material such as foamed polyurethane which is inert to the liquid carrier.

The spring 40 biases the plug 34 to closed position against the seat 20. Thereby when the birdfeeder valve is in place on the threaded neck of the bottle B after the fragile disc has been pierced by the pointed end of the spindle 38, the bottle is maintained closed and will stay closed even upon inversion of the bottle.

In operation, the birdfeeder valve 10 is screwed on the finish of a full bottle and upon so doing the pointed end of the spindle will pierce the protective disc. Then the bottle is turned upside down and is inserted in a copying machine. A typical copying machine has a support 48 into which the dispensing valve is inserted thereby serving to hold the valve and the bottle upside down. Associated with the support is a sump 50 having a bottom wall 52. The bottom wall is so situated as to be engaged by the lower chamfered end of the spindle 38. This will shift the spindle upwardly to raise the valve plug 34 off its valve seat 20 and thereupon liquid will flow out of the bottle through the birdfeeder valve into the sump. When the liquid reaches a certain level in the sump the hydrostatic forces acting on the liquid are in balance. As liquid is drawn out of the sump for use in the electrostatographic toner machine the hydrostatic balance will be disturbed causing further liquid to flow out of the bottle until equilibrium is reestablished. In some machines an element such as a flipper, intermittently opens the valve and then allows it to close, under the control of a sensing element that determines the need for additional liquid.

To assemble the prior art birdfeeder valve 10, the valve plug 34 is threaded on the spindle 38 to its approximate location and the spindle is inserted through the bore 26. The spring 40 is threaded on the lower end of the spindle. The two retainer rings must be positioned on the spindle 38. This can be done after the plug and the cap and the spring are positioned on the spindle or one of the rings can be emplaced first, thereafter the plug, cap and spring mounted on the spindle and finally the other ring emplaced. Regardless of the sequence of assembly of the components, the positioning of the rings is critical. The upper ring 42 must be so located that the valve plug 34 is correctly situated on the spindle to correctly engage the valve seat 20. The lower ring 44 must be so positioned with respect to the upper ring that the spring 40 is compressed to a desired degree. If the spring is incorrectly compressed, the force it exerts on the valve plug may not be suitable to maintain the birdfeeder valve closed under all conditions and if the degree of compression is too great it may not allow the birdfeeder valve to open correctly. Furthermore, there is a problem in putting the two rings on a spindle inasmuch as an operator would require three hands to hold both rings and the spindle at the same time. To encourage correct placement of the rings and to assist the operator in assembly, the prior art birdfeeder valve 10 conventionally employs a jig which usually holds the spindle at one end while one or both rings are being mounted. Even with the assistance of the jig, correct placement of the rings is most difficult; it has not been possible to automate assembly.

PREFERRED EMBODIMENT OF THE INVENTION

Turning now to FIGS. 2–6, the reference numeral 60 denotes a dispensing valve embodying the present invention and designed and adapted to dispense a fluent imaging material such as a liquid concentrate, or a working toner, or a diluent, or a dry toner powder in an electrostatographic copying machine. Like the prior art dispensing valve 10, the valve 60 is used in conjunction with a bottle B of such material. The dispensing valve 60 of the present invention includes only five components, in contrast to the seven components of the prior art dispensing valve 10.

The first component of the dispensing valve 60 is a cap 62 composed of a material inert to the organic liquid carrier in the bottle B, if it is liquid being dispensed, and to other components that are present in the liquid toner concentrate or in the working liquid toner should they be the contents of the bottle. An acceptable material for the cap 62 is a polyacetal. The skirt of the cap is formed with a female thread 64 designed to thread onto the male thread on the neck of the bottle B. The cap is screwed onto an upright full bottle B, the mouth of which is closed for shipment and storage by a fragile disc, e.g., a metal foil disc secured across the same. The cap includes an internally directed mid-flange 66 from which a sleeve 68 extends upwardly. The upper end of the sleeve constitutes a valve seat 70. A spider 72 is situated at the bottom of the sleeve 68. The hub 74 of the spider is formed with a central bore 76. A second sleeve 78 is formed integrally with the flange 66 and depends therefrom. The sleeves 68 and 78 are coaxial. However, the sleeve 78 may have an internal diameter somewhat larger than that of the sleeve 68. An annular well 80 is formed between the sleeve 68 and the skirt of the cap 62. The neck of the bottle B is received in this well. Another annular well 82 is formed between the lower end of the cap 62 and the sleeve 78, beneath the flange 66.

The second component of the dispensing valve 60 is a valve plug 84. The valve plug is made of an elastomeric material which is inert to the material in the bottle B, a useful material being Buna-N. The lower end of the valve plug 84 is of spherical domed configuration. The upper end of said plug is of upwardly tapering frustoconical configuration. Optionally, as illustrated, the upper end may include two segments of different angular inclinations, the lower segment being steeper and the upper segment being flatter; this does not affect the operation of the invention. The valve plug 84 is fashioned with a central axial bore 86. Preferably, the upper and lower surfaces of the valve plug are flat and perpendicular to the longitudinal axis of the bore.

As will be appreciated from the description of the new valve 60 as thus far set forth, the cap 62 and plug 84 of the new valve are identical to the cap 12 and plug 34 of the prior art dispensing valve 10. A minor difference may reside in the configuration of the plug 84, the height of which is slightly greater than that of the plug 34. This is a trivial design change. The differences between the valve 60 and the valve 10 reside in the spindle of the valve 60 and the manner of attachment of the plug 84 to such spindle which now will be pointed out.

The third component of the new dispensing valve 60 embodying the present invention is a plastic spindle 88. Unlike the spindle 38 of the valve 10, the spindle 88 is not of uniform diameter from end to end. Like the spindle 38, the spindle 88 is pointed at the top and chamfered at the bottom. However, the spindle 88 has an upper section 90 of a diameter smaller than that of the lower portion of said spindle whereby to provide an upwardly facing shoulder 92 at the lower end of the section 90. The lower end of the plug 84 is seated on this shoulder so that the shoulder precisely defines the location of said lower end; with this arrangement, the position of the plug on the spindle is exactly predetermined. The pointed top 94 of the spindle has a base whose diameter is in excess of the reduced diameter section 90 of the spindle, thereby providing a downwardly facing shoulder 96 where the reduced diameter portion 90 joins the pointed top. As shown in FIG. 2 of the drawings, the upper end of the plug 84 abuts the shoulder 96. Preferably, however, the shoulder 96 is spaced slightly, e.g., 0.020 from the upper surface of the plug 84. The plug 84 is located between the shoulders 92 and 96. The plug is able to assume and maintain this position without the use of an assembly jig, the shoulders serving an equivalent function. The reduced diameter section 90 of the spindle extends through the bore 86 of the plug 84. The plug is a friction fit on the reduced diameter section 90. If desired, and in order to minimize any tendency of the plug to shift on the reduced diameter section, said section is provided with one or more annular ribs 98 of buttress shape, with the flat sides that are perpendicular to the spindle facing downwardly toward the chamfered end of the spindle. The unequal inclination for the two sides of each rib is preferred since the pressure exerted on the spindle with respect to the plug is downward and the tendency for the plug to shift is upwardly, this being inhibited by the mentioned configuration of the ribs. The valve plug 84 is located above the spider 72 and is designed to be biased to closed position against the valve seat 70.

The fourth component is a stainless steel helical compression spring 100. One end of the spring is seated against the lower face of the spider hub 74. The other end of the spring is seated on a flange 102, either molded with or constituting a ring fixedly secured to the spindle 88. The position of the ring is predetermined, that is to say, fixed before assembly of the valve 60. Thereby the degree of compression of the spring between said ring and the spider can be determined and fixed in advance of assembly, bearing in mind that the position of the plug likewise is fixed, so that the distance between the seat 70 and the flange 102 is a predetermined fixed distance.

By way of contrast with the prior art dispensing valve 10, the new dispensing valve of the present invention does not utilize the fifth and sixth elements of said dispensing valve 10. These are wholly dispensed with, their function being provided by the shoulders 92, 96 and the flange 102 which are a part of the spindle 88.

The fifth and last component of the valve 60 is a sealing gasket 104 seated at the bottom of the well 80 to prevent leakage of liquid when the cap 62 is screwed on the mouth of the bottle B. The gasket is formed of a resilient material such as foamed polyurethane which is inert to the fluent imaging material.

The spring 100 biases the plug 84 to closed position against the seat 70. Thereby when the dispensing valve is in place on the threaded neck on the bottle B after the fragile disc has been pierced by the pointed tip 94 of the spindle 88, the bottle is maintained closed and will stay closed even upon inversion of the bottle.

In operation as a birdfeeder valve, the dispensing valve is screwed on the finish of a full bottle B and, upon so doing, the pointed tip 94 of the spindle will pierce the protective disc. Then the bottle is turned upside down and is inserted in a copying machine. As noted previously, a typical copying machine has a support 48 into which the dispensing valve—in this instance, the valve 60—is inserted, thereby serving to hold the valve and the bottle upside down. The support is so positioned as to hold the valve in the sump 50 having the bottom wall 52, with the bottom wall so situated as to be engaged by the lower chamfered end of the spindle 88 when the bottle is inserted into the machine on the support. This will shift the spindle 88 upwardly so as to raise the valve plug 84 off its valve seat 70 and thereupon fluent imaging material will flow out of the bottle through the birdfeeder valve 60 into the sump. When the material reaches a certain level in the sump, the hydrostatic forces acting on it are in balance. As the material is drawn out of the sump for use in the electrostatographic copy machine, the hydrostatic balance will be disturbed, causing further material to flow out of the bottle until hydrostatic equilibrium is reestablished. The valve 60 in the foregoing respects functions no differently from the valve 10.

When used as an intermittently opened valve, the valve 60 normally is closed. When there is demand for additional material, determined by a sensing element, a member, e.g., a flipper, normally out of contact with the lower end of the spindle, raises to lift the spindle and open the valve. When the member drops, either after a period of time or under the control of the sensory element the valve recloses.

To assemble the valve 60, the spring 100 is threaded on the spindle 88 over the point 94 until it abuts the flange 102. Then the upper portion of the spindle is inserted through the bore 76 until the point 94 extends beyond the seat 70. Thereafter, the plug 84 is pushed over the point 94 until its lower flat surface butts against the shoulder 92 and its upper flat surface clears the shoulder 96. At this time, the plug is properly located without the use of a jig, and the spring 100 is properly compressed likewise without the use of a jig. The valve 60 is now ready for use. This assembly operation lends itself to the use of automatic machinery.

A full bottle having a dispensing valve mounted on its neck is vulnerable in a certain respect, namely, the disc on the mouth of the bottle has been pierced by the pointed tip of the spindle so that when the bottle is inverted the only thing that stops the contents of the bottle from flowing out through the dispensing valve is the closed position of the plug. Due to the manner in which the dispensing valve is used, to wit, so structuring the same that pressure on the chamfered end of the valve mounted on an inverted bottle will open the valve, if through mischance, as sometimes occurs, the chamfered end inadvertently is brought to bear upon an object, or vice versa, the contents of the bottle will flow out of the valve into the open. This is undesirable because the contents are expensive, because they may stain fabrics, and because the liquid carrier, if it is present, acts as a solvent for some types of plastics. To prevent this from happening, pursuant to an ancillary feature of the invention, protective means may be supplied.

As illustrated in FIGS. 4, 5 and 6, certain additional elements are included. These constitute a clip 106 and an overcap 108. The purpose of the clip is to prevent shifting of the spindle into a valve-open position. The purpose of the overcap is to prevent the protruding chamfered end of the spindle from being pressed away from the valve-closed position. Together, the clip and overcap prohibit inadvertent opening of the valve. The clip and overcap are made of plastic. The clip is in the form of a disc 110, the diameter of whose periphery is substantially equal to the outer diameter of the lower end of the sleeve 78. The clip is adapted to be seated on the lower sleeve end as shown in FIG. 5. The clip is formed with a diametrical slot 112 extending inwardly from the circumference of the disc to somewhat past its center. The width of the slot is in excess of the diameter of the unreduced section of the spindle 88. The disc further includes manipulating means in the shape of one or more protuberances 114 extending away from the surface of the disc that is remote from the sleeve 78. These protuberances are adapted to be grasped by an operator's hands for manipulation of the disc. It is contemplated that only a single protuberance can be used which can be grasped between a user's thumb and forefinger, or that, as shown, two protuberances are included, the same being parallel and on opposite sides of the slot 112. These protuberances are formed in the cross-section of arrows, both pointing in the same direction. The purpose of this will be immediately apparent. The disc is located between the flange 102 and the lower end of the spring 100 as best shown in FIG. 5, so that the spring 100 is under compression between the hub 74 and the disc 110, rather than between the hub and the flange 102. Thereafter, assembly of the valve proceeds as described above.

However, now the spindle extends through the slot, and the disc is held between the lower end of the spring and the flange 102 which press against opposite sides of the disc. Due to the presence of the disc, the valve plug cannot be shifted away from its closed position. It is prevented from so doing by abutment of the flange 102 against the underside of the disc while the disc is seated on the lower end of the sleeve 78. This prevents inadvertent opening of the valve, but when it is desired to use the valve, the operator simply slides the disc 110 off the spindle in the direction of the arrows, using the protuberances 114 as, in effect, a handle.

Finally, to provide further protection against inadvertent striking of the spindle 88 and opening of the valve 60, the overcap 108 is applied to the valve to form a complete cover therefor. The overcap is shaped to fit nestedly over the cap 62. It will be seen that the cap 62 is formed with a fluted exterior constituting ribs 116. The interior of the overcap is shaped to snugly fit over the cap and is formed with internal ribs 118 that are disposed to enter between spaced ones of the ribs 116. This enables the overcap to be rotated and to rotate the valve 60 when it is desired to apply this valve to the threaded neck of a bottle B. Thus, the overcap does not have to be removed in order to cause the valve 60 to engage with or disengage from the bottle. The open mouth of the overcap is formed with a squat flange 120 which engages the upper end of the cap 62 to maintain the overcap in position on the valve 60. The retention afforded by the flange is quite slight, so that after the valve 60 is mounted on a bottle B, the overcap easily can be pulled off to expose the clip 106 which thereupon is slid off to render the dispensing valve 60 fully operative.

As mentioned earlier, if the fluid being dispensed is dry toner powder, it is advantageous to have a vibrator operatively coupled to the powder container to encourage fluid flow and prevent bridging.

The valve, as thus far set forth, has been described with respect to its use as applied to a container filled with a fluent imaging material of the type mentioned hereinabove which has been closed with a penetratable disc and capped with a removable cover such as a screw cover. With such a valve, the cover is unscrewed, and the valve is screwed on the neck of the container, the disc being penetrated by a point on the valve as the valve engages the neck of the container. However, the valve may be applied to the container in a manner which eliminates the disc and cover, the valve, in such case, serving as a cover. In other words, the valve can be applied to the open mouth of the container after the container has been filled, e.g. at a filling plant, after which the valve prevents accidental escape of the fluent imaging material within the container. This feature of the present invention is the subject of a co-pending application, Ser. No. 303,380, filed on Sept. 18, 1981, by Frederick J. Pritchitt and Gary E. Gendron, for VALVE AND OVERCAP FOR USE WITH CONTAINER FILLED WITH FLUENT IMAGING MATERIAL USED IN LIQUID OR DRY ELECTROSTATOGRAPHIC COPYING MACHINES, said feature being described and claimed in said co-pending application, and described but not claimed in the present application.

Pursuant to this feature, and referring to FIG. 5, the valve cap 62 is permanently secured to the finish, i.e. neck, of the container B. By "permanently secured" as used herein it is meant that the valve cannot be removed from the container unless extraordinary means are utilized to so remove the valve. In other words, either the valve cap or the container finish must be mutilated or destroyed in order to separate them from each other. In ordinary usage, the valve cap cannot be detached from the container once it has been attached as by screwing on at the factory after the container has been filled. Various arrangements can be employed to effect this permanent attachment. Two such arrangements are illustrated and described in said co-pending application Ser. No. 303,380 filed Sept. 18, 1981.

The first of these which now will be described is illustrated and described in said co-pending application Ser. No. 303,380 filed Sept. 18, 1981, but will here only be described without illustration. In this arrangement, the gasket 104 which is interposed between the crown of the valve cap 62 and the outer end of the finish of the container B is made of a thermoplastic material compatible with the thermoplastic material of which the container is made. A typical thermoplastic material is polyethylene. The gasket is embedded with dispersed ferrous particles so that when the gasket is subjected to a high frequency induction heating field, the ferrous particles will heat to a temperature sufficient to render the thermoplastic material of the gasket soft and tacky. In its soft and tacky state, the gasket will bond to the finish of the container B and to the crown of the valve cap with which it is compatible and, upon cooling, when removed from the high frequency electromagnetic field, provide a permanent attachment between the valve cap and the container B. (As observed above, the permanent attachment denotes an attachment that will not separate during ordinary use and handling, only being broken by mutilating and destroying either or both of the component parts which have been permanently attached to each other.) Prior to effecting the permanent attachment, the container B has been filled with fluent imaging material which now is effectively held within the container against accidental removal and only being removable from the container by actuation of the spindle 88.

The second arrangement used for effecting a permanent attachment between the valve cap and the finish of the container, this arrangement also being illustrated and described in the said co-pending application Ser. No. 303,380 filed Sept. 18, 1981, as well as the instant application, is an arrangement in which a ratchet engagement permits the valve cap to be turned relative to the finish in a tightening direction of the cap on the finish but prevents retrograde movement of the cap. Such an arrangement includes the provision of buttress teeth at the base of the neck of the container where the neck meets the body of the container, and of opposing buttress teeth at the open end of the inner surface of the valve cap in transverse registration with the buttress teeth on the neck of the container. The buttress teeth on the neck of the container are indicated by the reference numeral 122 and those on the cap by the reference numeral 124. Neither set of buttress teeth has to constitute a complete ring of such teeth.

With either of the aforesaid arrangements, the cap 62 is permanently attached to a container previously filled with fluent imaging material and can be installed in an electrostatographic fluid copying machine after removal of the clip and the overcap. After the fluent imaging material is used up, the empty container can be discarded.

It thus will be seen that there is provided a valve and method for assembling same which achieve the various objects of the invention and which are well adapted to meet the conditions of practical use.

As various possible embodiments might be made of the above invention, and as various changes might be made in the embodiment above set forth, it is to be understood that all matter herein described or shown in the accompanying drawings is to be interpreted as illustrative and not in a limiting sense.

I claim:

1. A dispensing valve to be used on a supply bottle containing a fluent imaging material adapted to be employed in an electrostatographic copying machine, said bottle including a male half of a copending means, said valve comprising:

(A) a valve cap having a skirt that is provided internally with a female half of a coupling means adapted to mesh with the male half of the coupling means on the bottle neck, (B) the valve cap having a central opening for passage of fluent imaging material from the bottle therethrough, (C) a spider in said opening, (i) the spinder having a bore coaxial with the opening in the cap, (D) a valve seat at the end of the central opening in the cap and facing the interior of the bottle, (E) a plastic spindle extending through the bore in the spider, (i) a flange molded in one piece with the spindle on the side of the spider remote from the valve seat, (F) a helical compression spring under compression between the spider and the flange, (G) the spindle having on the side of the spider remote from the spring a portion of reduced diameter to form a first shoulder where it joins the remainder of the spindle, (H) the spindle further having a top portion above the seat and adapted to be received within the bottle when the dispensing valve is mounted thereon, said top portion being pointed and having a base with a diameter greater than that of the reduced diameter portion of the spindle to form with the reduced diameter portion of the spindle a second shoulder facing the first shoulder, (J) a resilient centrally bored valve plug friction fitted on the reduced diameter portion of the spindle with its upper end butting against said second shoulder, (K) the space between the two shoulders being slightly less than the axial length of the valve plug so as to hold the valve plug under compression between said shoulders, (L) the top and bottom of the valve plug being substantially flat where they butt against said shoulders, (M) the reduced diameter portion of the spindle including at least one annular rib to engage the central bore of the valve plug and inhibit axial shifting of said plug, and (N) said rib having a steeply inclined side facing the spider.

2. A dispensing valve to be used on a supply bottle containing a fluent imaging material adapted to be employed in an electrostatographic copying machine, said bottle including a male half of a coupling means, said valve comprising:

(A) a valve cap having a skirt that is provided internally with a female half of a coupling means adapted to mesh with the male half of the coupling means on the bottle neck, (B) the valve cap having a central opening for passage of fluent imaging material from the bottle therethrough, (C) a spider in said opening, (i) the spider having a bore coaxial with the opening in the cap, (D) a valve seat at the end of the central opening in the cap and facing the interior of the bottle, (E) a plastic spindle extending through the bore in the spider, (i) a flange molded in one piece with the spindle on the side of the spider remote from the valve seat, (F) a helical compression spring under compression between the spider and the flange, (G) the spindle having on the side of the spider remote from the spring a portion of reduced diameter to form a first shoulder where it joins the remainder of the spindle, (H) the spindle further having a top portion above the seat and adapted to be received within the bottle when the dispensing valve is mounted thereon, said top portion being pointed and having a base with a diameter greater than that of the reduced diameter portion of the spindle to form with the reduced diameter portion of the spindle a second shoulder facing the first shoulder, (J) a resilient centrally bored valve plug friction fitted on the reduced diameter portion of the spindle with its upper end butting against said second shoulder, and (K) the reduced diameter of the spindle including at least one annular rib to engage the central bore of the valve plug and inhibit axial shifting of said plug.

3. A dispensing valve as set forth in claim 2 wherein said rib has a steeply inclined side facing the spider.

* * * * *